United States Patent [19]

Watanabe

[11] Patent Number: 4,692,021

[45] Date of Patent: Sep. 8, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 788,209

[22] Filed: Oct. 16, 1985

[30] Foreign Application Priority Data

Oct. 19, 1984 [JP] Japan ..... 59-219923

[51] Int. Cl.[4] ..... G03G 15/00

[52] U.S. Cl. ..... 355/14 R; 355/7; 355/8

[58] Field of Search ..... 355/14 R, 14 C, 14 SH, 355/3 R, 7, 8, 55, 75

[56] References Cited

U.S. PATENT DOCUMENTS 4,595,273 6/1986 Watanabe et al. ..... 355/8 X

FOREIGN PATENT DOCUMENTS 58-172644 10/1983 Japan ..... 355/14 C
59-60450 4/1984 Japan .
59-178422 10/1984 Japan .

*Primary Examiner*—Arthur T. Grimley
*Assistant Examiner*—J. Pendegrass
*Attorney, Agent, or Firm*—Cushman, Darby & Cushman

[57] ABSTRACT

An image forming apparatus and method which drives a display device and an optical scanning device to visually depict an image-reproducible range which is set in accordance with a selected magnification/reduction factor. The display device includes two indicators positioned adjacent the original document table and movable with respect to each other to indicate a first dimension on the document table. The optical scanning device includes an indicator which moves relative to the original document table to indicate the second dimension of the image-reproducible range. The apparatus further includes an interlocking device for interlockingly driving the display device with the movement of the optical scanning device. Control circuitry controls the driving of the interlocking device in accordance with the selected magnification/reduction factor and the size of the sheet upon which the copy is made. The control device controls the driving of the interlocking means until the display device is moved to a predetermined position, to permit the display device to interlockingly move with the movement of the optical scanning device. When the display device reaches the predetermined position, the interlocking means is de-energized to permit movement of the optical scanning device only.

18 Claims, 11 Drawing Figures

IMAGE FORMING APPARATUS

BACKGROUND OF THE INVENTION

This invention relates to an image forming apparatus and method applied to an electronic copying machine, and more specifically to an image forming apparatus which comprises a photosensitive body holding an electric charge, charging means for applying an electric charge to the photosensitive body, exposure means for optically scanning an image of an original and exposing the photosensitive body charged by the charging means, thereby forming an electric charge pattern in response to the original image, and developing means for developing the electric charge pattern formed on the photosensitive body by exposure techniques.

In general, electronic copying machines copy an image of the original onto a paper sheet directly or in an enlarged or reduced scale. An electronic copying machine of this type is known which is adapted for copying (at a reduced or enlarged scale) an original placed on the document table, with the size and number of copies determined by indicators disposed on the reverse side of the document table. If the copying range is indicated, it is possible to prevent a possible setting error in the copying size.

However, this type of machine is very expensive, because the indicators are driven by dedicated motors.

SUMMARY OF THE INVENTION

It is accordingly an object of this invention to provide an image forming apparatus which can provide an inexpensive display means without increasing the number of component parts required.

According to the present invention, method and apparatus are provided for displaying an image-reproducible range of an original sheet in accordance with a selected magnification/reduction factor. The display device includes two indicators positioned adjacent the original document table and movable with respect to each other to indicate a first magnification/reduction dimension on the document table. An optical scanning device includes an indicator which moves relative to the original document table to indicate the second dimension of the magnification/reduction range. Preferably, an interlocking device drives the display device with the movement of the optical scanning device. Control circuitry preferably drives the interlocking device in accordance with the selected magnification/reduction factor and the size of the sheet upon which the magnification/reduction image is to be made. The invention also provides a method for moving the indicators and the carriage in order to visually depict the image-reproducible range.

DETAILED DESCRIPTION OF THE PREFERRED EMBODIMENTS

One embodiment of this invention will now be described in detail with reference to the accompanying drawings.

Figure 1:
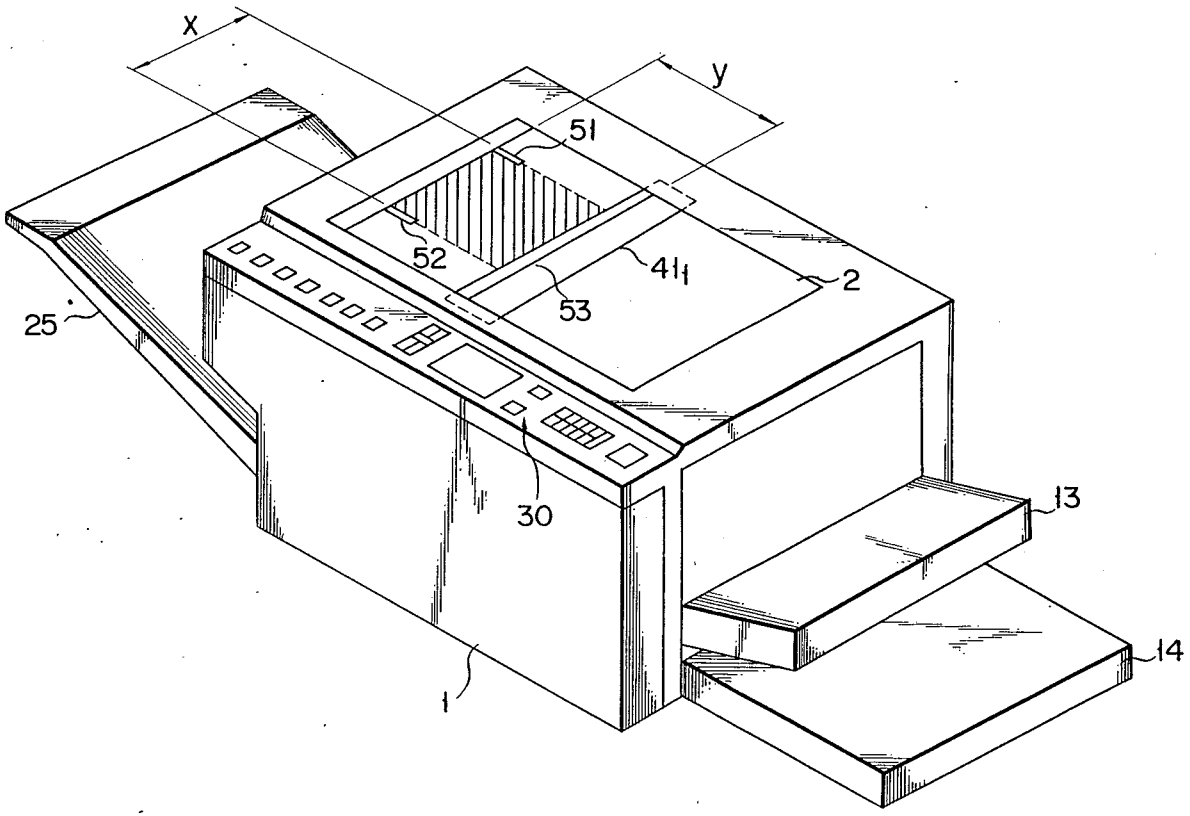
FIGS. 1 and 2 are a schematic perspective view and a side sectional view, respectively, showing the construction of the image forming apparatus.
Figure 2:
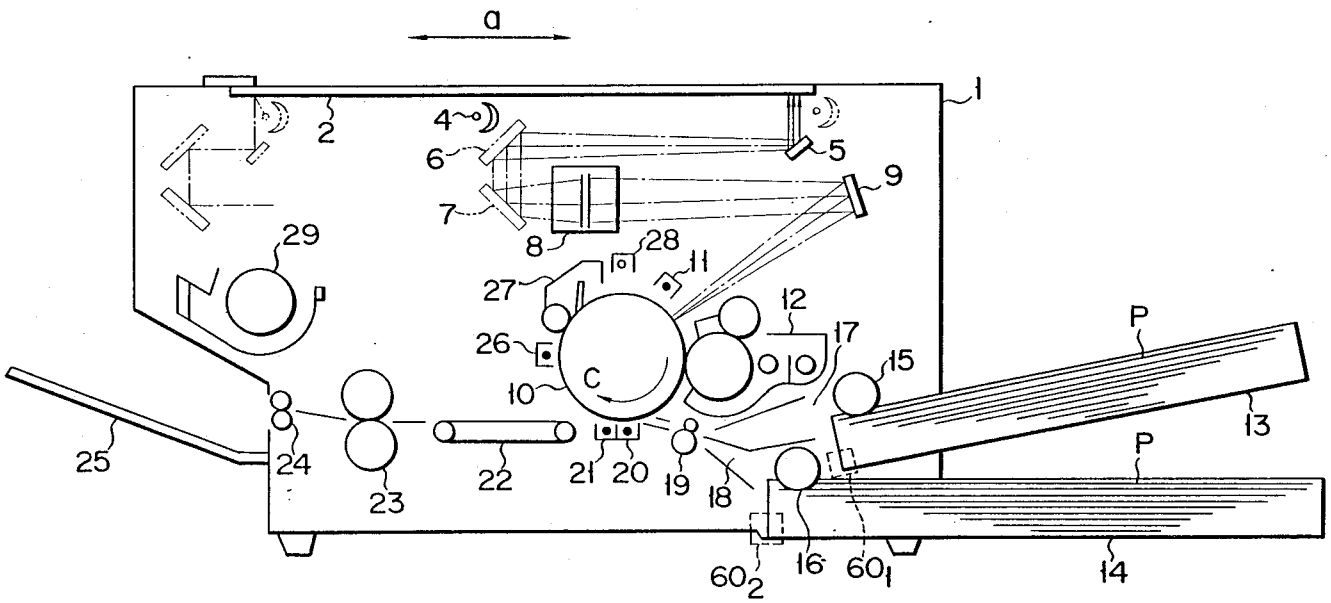

FIGS. 1 and 2 schematically show a copying machine as an image forming apparatus according to an exemplary embodiment of this invention. In FIGS. 1 and 2, numeral 1 designates a housing of the copying machine. An original table 2 (transparent glass) for carrying an original is fixed on the top of housing 1 (original cover is not shown). The original document set on original table 2 is scanned for image exposure by optical system 3 including exposure lamp 4 and mirrors 5, 6 and 7 which reciprocate in the direction indicated by arrow 'a' along the under surface of the original table 2. In this case, mirrors 6 and 7 move at a speed half that of mirror 5 so as to maintain a fixed optical path length.

Exposure lamp 4 illuminates the original document. A light beam reflected from the original is scanned by optical system 3, is further reflected by mirrors 5, 6 and 7, transmitted through lens block 8 for magnification or reduction, and then reflected by mirror 9 to be projected on photosensitive drum 10. Thus, an image of the original is formed on the surface of photosensitive drum 10.

Photosensitive drum 10 rotates in the direction indicated by arrow 'c' so that its surface is completely precharged by main charger 11. The image of the original is projected on the charged surface of photosensitive drum 10 by split exposure, forming an electrostatic latent image on the surface. The electrostatic latent image is developed into a visible image (toner image) by developing unit 12 using toner. Paper sheets (image record media) 'P' are delivered one by one from upper paper cassette 13 or lower paper cassette 14 by paper-supply roller 15 or 16, and guided along paper guide path 17 or 18 to aligning roller pair 19. Then, each paper sheet 'P' is delivered to the transfer region by aligning roller pair 19, timed to the formation of the visible image.

Paper cassettes 13 and 14 are removably attached to the lower right end portion of housing 1, and can be alternated by selective operation on the control panel which will be described in detail later. Paper cassettes 13 and 14 are provided with cassette size detecting switches $\mathbf{60}_1$ and $\mathbf{60}_2$ which detect the selected cassette size. Detecting switches $\mathbf{60}_1$ and $\mathbf{60}_2$ are each formed by microswitches which are turned on or off in response to insertion of cassettes of different sizes.

Paper sheet 'P' delivered to the transfer region comes into close contact with the surface of photosensitive drum 10, in the space between transfer charger 20 and drum 10. As a result, the toner image on photosensitive drum 10 is transferred to paper sheet 'P' by charger 20. After the transfer, paper sheet 'P' is separated from the photosensitive drum 10 by separation charger 21 and transported by conveyor belt 22. Thus, paper sheet 'P' is delivered to fixing roller pair 23 which is arranged at the terminal end portion of conveyor belt 22. As paper sheet 'P' passes through fixing roller pair 23, the transferred image is fixed on sheet 'P'. After the fixation, paper sheet 'P' is discharged into tray 25 outside housing 1 by exit roller pair 24.

After the transfer, photosensitive drum 10 is de-electrified by de-electrification charger 26, when the residual toner on the surface of drum 10 is removed by cleaner 27. Thereafter, a residual image on photosensitive drum 10 is erased by discharge lamp 28 to restore it to the initial state. In FIG. 2, numeral 29 designates a cooling fan for preventing the temperature inside housing 1 from rising.

Figure 3:
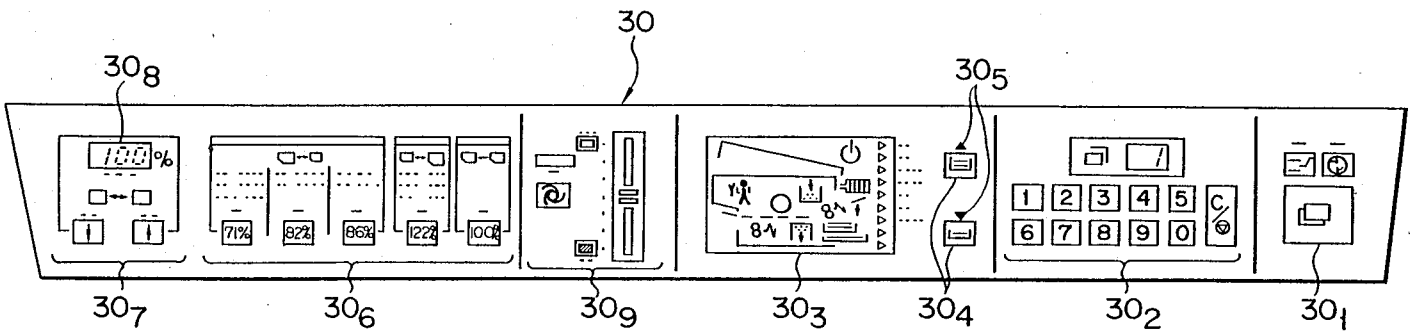
FIG. 3 is a plan view of a control panel.

FIG. 3 shows control panel 30 mounted on housing 1. Control panel 30 carries thereon: copy key $30_1$ for starting the copying operation, ten-keys $30_2$ for setting the number of copies to be made and the like, display section $30_3$ for indicating the operating conditions of the individual parts or paper jamming, cassette selection keys $30_4$ for alternatively selecting upper or lower paper cassette 13 or 14, and cassette display section $30_5$ for indicating the selected cassette. Control panel 30 is further provided with ratio setting keys $30_6$ for setting the enlargement or reduction ratios, zoom keys $30_7$ for adjustably setting the enlargement or reduction ratio, display section $30_8$ for displaying the set ratio, and density setting section $30_9$ for setting the copy density.

Figure 4:
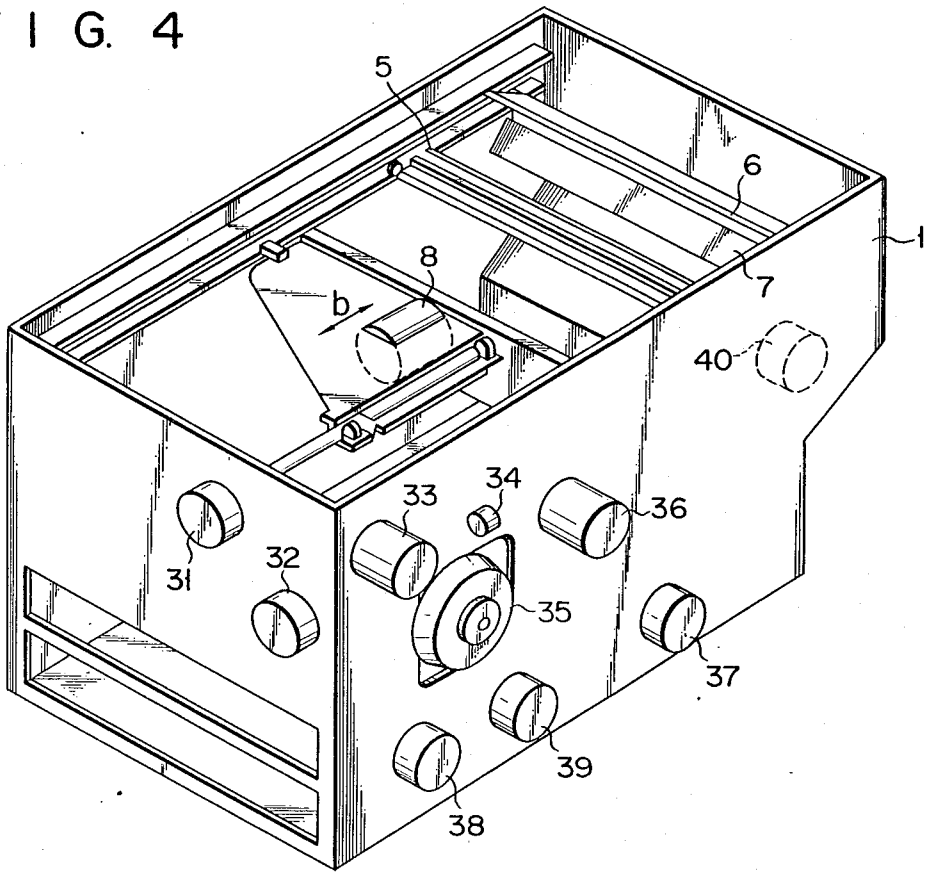
FIG. 4 is a perspective view showing an arrangement of drive sections.

FIG. 4 shows a specific arrangement of drive sources for individual drive sections of the copying machine constructed in this manner. The drive sources include the following motors. Numeral 31 designates the motor for the lens drive. Lens drive motor 31 serves to shift the position of lens block 8 for magnification or reduction. Numeral 32 designates the motor for mirror drive. Mirror drive motor 32 serves to change the distance (optical path length) between mirror 5 and mirrors 6 and 7 for magnification or reduction. Numeral 33 designates the motor for scanning. Scanning motor 33 serves to move exposure lamp 4 and mirrors 5, 6 and 7 for scanning the original. Numeral 34 designates the motor for the shutter drive. Shutter drive motor 34 serves to move the shutter (not shown) for adjusting the width of charging of photosensitive drum 10 by charger 11 at the time of magnification or reduction.

Numeral 35 designates the motor used for developing. Developing motor 35 serves to drive the developing roller and the like of developing unit 12. Numeral 36 designates the motor used to drive the drum. Drum drive motor 36 serves to drive photosensitive drum 10. Numeral 37 designates the motor for fixation. Fixing motor 37 serves to drive sheet conveyor belt 22, fixing roller pair 23, and exit roller pair 24. Numeral 38 designates the motor for paper supply. Paper supply motor 38 serves to drive paper supply rollers 15 and 16. Numeral 39 designates the motor for feeding sheets. Sheet feed motor 39 serves to drive aligning roller pair 19. Numeral 40 designates the motor for fan drive. Fan drive motor 40 serves to drive cooling fan 29.

Figure 5:
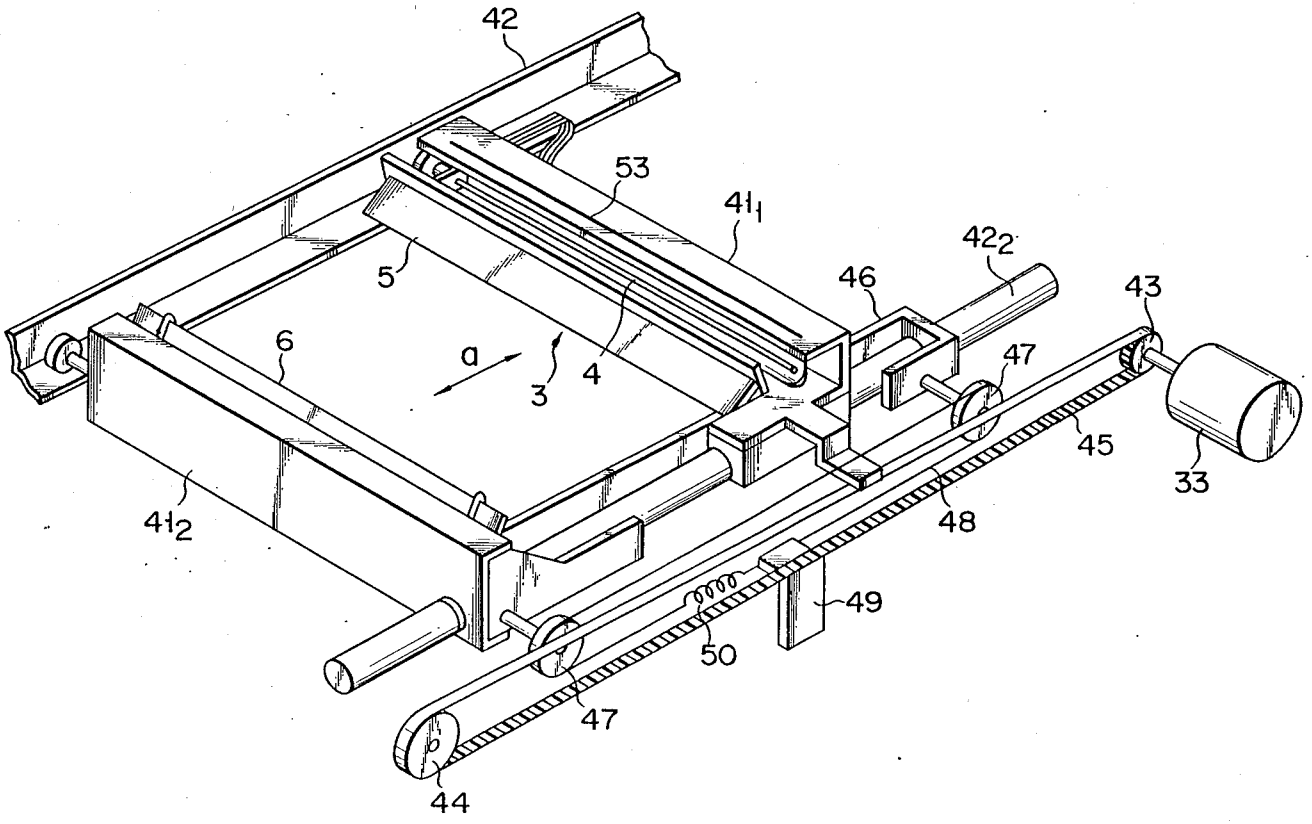
FIG. 5 is a perspective view schematically showing a drive mechanism for an optical system.

FIG. 5 shows the drive mechanism for reciprocating optical system 3. Mirror 5 and exposure lamp 4 are supported by first carriage $41_1$, and mirrors 6 and 7 by second carriage $41_2$. Carriages $41_1$ and $41_2$ move in parallel in the direction indicated by arrow 'a', guided by guide rails $42_1$ and $42_2$. Four-phase pulse motor 33 drives pulley 43. Endless belt 45 is stretched between pulley 43 and idle pulley 44, and one end of first carriage $41_1$ supporting mirror 5 is the intermediate portion of belt 45.

On the other hand, two pulleys 47 are rotatably attached to guide portion 46 (for rail $42_2$) of second carriage $41_2$ supporting mirrors 6 and 7, spaced in the axial direction of rail $42_2$. Wire 48 is connected between two pulleys 47. One end of wire 48 is connected thereto by means of coil spring 50. One end of first carriage $41_1$ is fixed to the intermediate portion of wire 48.

With this arrangement, when pulse motor 33 is driven, belt 45 turns around to move first carriage $41_1$. As first carriage $41_1$ travels, second carriage $41_2$ also travels. Since pulleys 47 serve as movable pulleys, second carriage $41_2$ travels in the same direction as and at a half speed of first carriage $41_1$. The travelling direction of first and second carriages $41_1$ and $41_2$ is controlled by changing the rotating direction of pulse motor 33.

Figure 6:
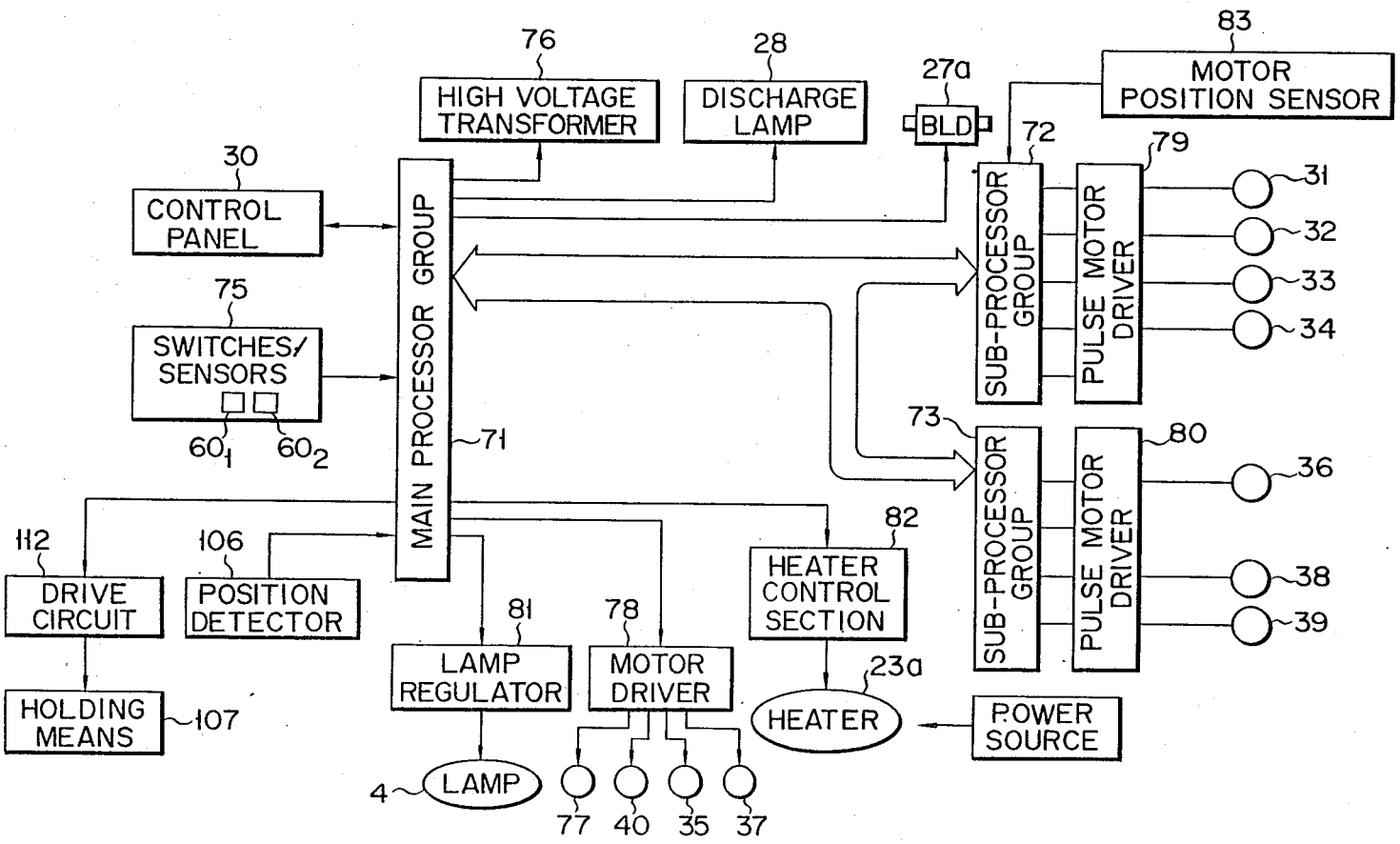
FIG. 6 is a block diagram showing a general control circuit.

FIG. 6 shows a general control circuit of the electronic copying machine. This control circuit is mainly composed of main processor group 71 and first and second sub-processor groups 72 and 73. Main processor group 71 detects input data from control panel 30 and group of input devices 75 including various switches and sensors, such as cassette size detection switches $60_1$ and $60_2$, and controls high voltage transformer 76 for driving the chargers, discharge lamp 28, blade solenoid **27*a* of cleaner 27, heater 23*a* of fixing roller pair 23, exposure lamp 4, and motors 31 to 40**, thus accomplishing the copying operation.

Motors 35, 37 and 40 and toner-supply motor 77 for supplying the toner to developing unit 12 are connected through motor driver 78 to main processor group 71 to be controlled thereby. Motors 31 to 34 are connected through pulse motor driver 79 to first sub-processor group 72 to be controlled thereby. Motors 36, 38 and 39 are connected through pulse motor driver 80 to second sub-processor group 73 to be controlled thereby.

Further, exposure lamp 4 is controlled by main processor group 71 through lamp regulator 81, and heater **23*a* by main processor group 71 through heater control section 82. Main processor group 71 gives instructions for the start or stop of the individual motors to first and second sub-processor groups 72 and 73. First and second sub-processor groups 72 and 73 feed main processor group 71 with status signals indicative of the operation mode of the motors. Also, first sub-processor group 72 is supplied with positional information from position sensor 83 for detecting the respective initial positions of motors 31 to 34**.

An output signal of position detector 106, as set out below, is supplied to the above-mentioned main processor group 71. Drive circuit 112 for driving holding means 107, as set out below, is operated by an output signal of main processor group 71.

Original table 2 carries thereon an indication of an image-reproducible range corresponding to the size of the designated paper sheets. If the sheet size designated by sheet selection keys $30_4$ and the copy ratio specified by ratio setting keys $30_4$ or $30_7$ are (Px, Py) and K, respectively, the image-reproducible range (x, y) is given by $x = Px/K$, $y = Py/K$.

Out of the coordinates (x, y) designating any point within the image-reproducible range, as shown in FIG. 1, the x coordinate is indicated by indexes 51 and 52 arranged on the inside of original table 2, and the y coordinate by scale 53 provided on the top face portion of first carriage $41_1$.

Figure 7:
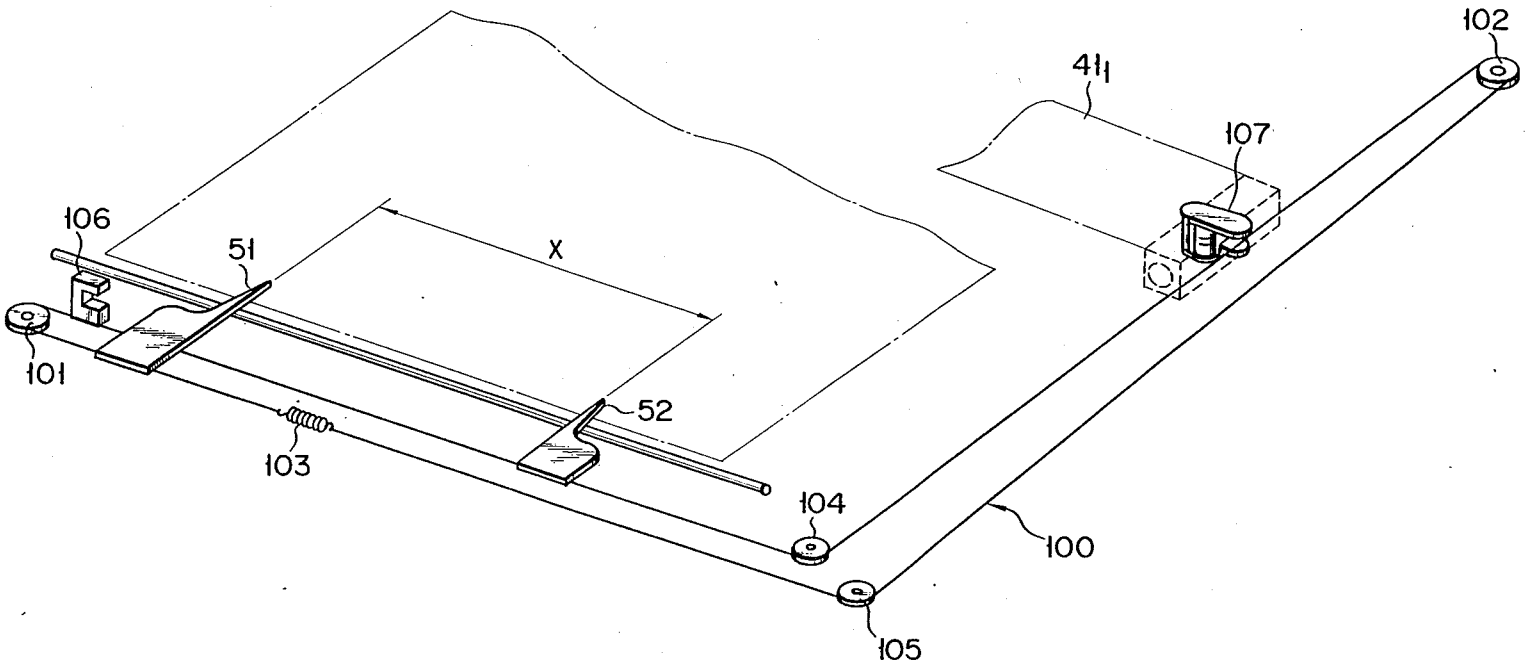
FIG. 7 is a perspective view showing only the major part of the image forming apparatus which permits indicators to be moved relative to each other in interlocking movement with the first carriage movement to set an image-reproducible range.

FIG. 7 shows the details of indicators 51,52. Indicators 51, 52 are driven by wires 100 stretched between pulleys 101 and 102 through spring 103. Pulleys 104 and 105 are located intermediate between pulleys 101 and 102. Wire 100 is bent at right angles at the positions of pulleys 104 and 105 where it extends along the lateral and longitudinal directions of table 2. Indicators 51 and 52 are located one between pulleys 101 and 104 and one between pulleys 101 and 105. Position detector 106 is provided in the neighborhood of indicator 51 and comprised of, for example, a photocoupler and is adapted to detect indicator 51. An output signal of position detector 106 is supplied to main processor group 71.

Figure 8:
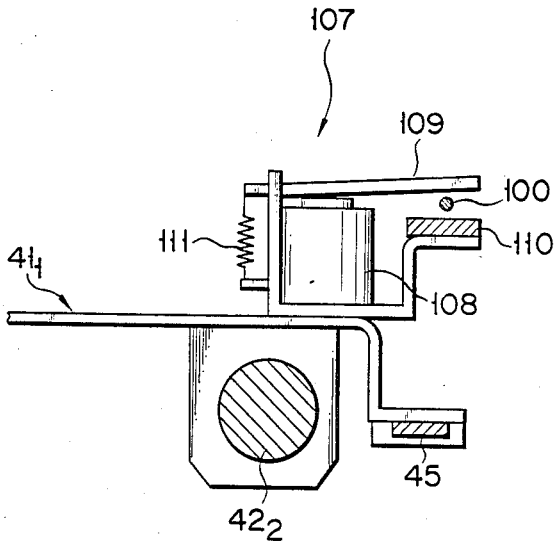
FIG. 8 is a side view showing the holding means of the apparatus with a portion of FIG. 7 removed.

Holding means 107 is provided between pulleys 102 and 104, 105 and serves as an interlocking means capable of selectively holding one of two parallel runs of wire 100. Holding means 107 comprises electromagnet 108, armature 109, pressure contact member 110 and spring 111 as shown in FIG. 8. Armature 109 is attracted by electromagnet 108 and pressure contact member 110 holds wire 100 with armature 109 attracted thereto. Pressure contact member 110 is made of a material of a high coefficient of friction, such as rubber, to permit wire 100 to be gripped or held in cooperation with armature 109. Spring 111 normally urges armature 109 away from electromagnet 108. Holding means 107 is attached to first carriage $41_1$. Holding means 107 is excited through drive circuit 112 operated by an output signal of main processor group 71.

The operation of main processor group 71 for image-reproducible range display will now be explained below with reference to the flow chart of FIG. 9. Suppose that indicators 51, 52 and scale 53 of first carriage $41_1$ are located in position ($X_1$, $Y_1$) as shown in FIG. 10. In this state, when ratio setting key $30_6$ and zoom key $30_7$ on control panel 30 are operated, drive circuit 112 is operated to permit electromagnet 108 on holding means 107 to be excited (Step 1). By so doing, wire 100 is sandwiched in proper place between armature 109 and pressure contact member 110. In this state, pulse motor 33 is driven so as to cause first carriage $41_1$ to be moved away from indicators 51, 52 (Step 2). When this is done, wire 100 is operated in cooperation with first carriage $41_1$ to permit indicators 51, 52 to be moved away from each other. Pulse motor 33 is driven until indicator 51 is detected by position detector 106 after it has been moved by distance $l_1$ (Step 3). When pulse motor 33 is stopped, pulse motor 33 and thus first carriage $41_1$ are stopped (Step 4). Then, pulse motor 33 is driven so that first carriage $41_1$ is moved toward indicators 51, 52 (Step 5). Pulse motor 33 is driven until indicators 51 and 52 are moved distance $l_2$ relative to each other so as to obtain distance $X_2$ therebetween corresponding to a set ratio (Step 6). With the indicators so moved by distance $l_2$, pulse motor 33 and then first carriage $41_1$ are stopped (Step 7). In this state, electromagnet 108 on holding means 107 is de-magnetized by an output signal of drive circuit 112, releasing the holding state of wire 100 (Step 8). Then, pulse motor 33 is driven to permit scale 53 on first carriage $41_1$ to be moved to a position corresponding to the set ratio (Step 9). Pulse motor 33 continues to be driven until the above-mentioned position is reached (Step 10). Once this position is reached, pulse motor 33 and thus first carriage $41_1$ are stopped (Step 11).

According to this invention, wire 100 for driving above-mentioned indicators 51, 52 is held or gripped by above-mentioned holding means 107 and, in this state, indicators 51, 52 are moved with a movement of first carriage $41_1$. This arrangement requires no conventional dedicated motor for driving above-mentioned indicators 51, 52. According to this invention, it is possible to make the respective component parts and thus the apparatus lower in cost without increasing the number of component parts required.

The image forming apparatus according to another embodiment of this invention will be explained below.

Figure 11:
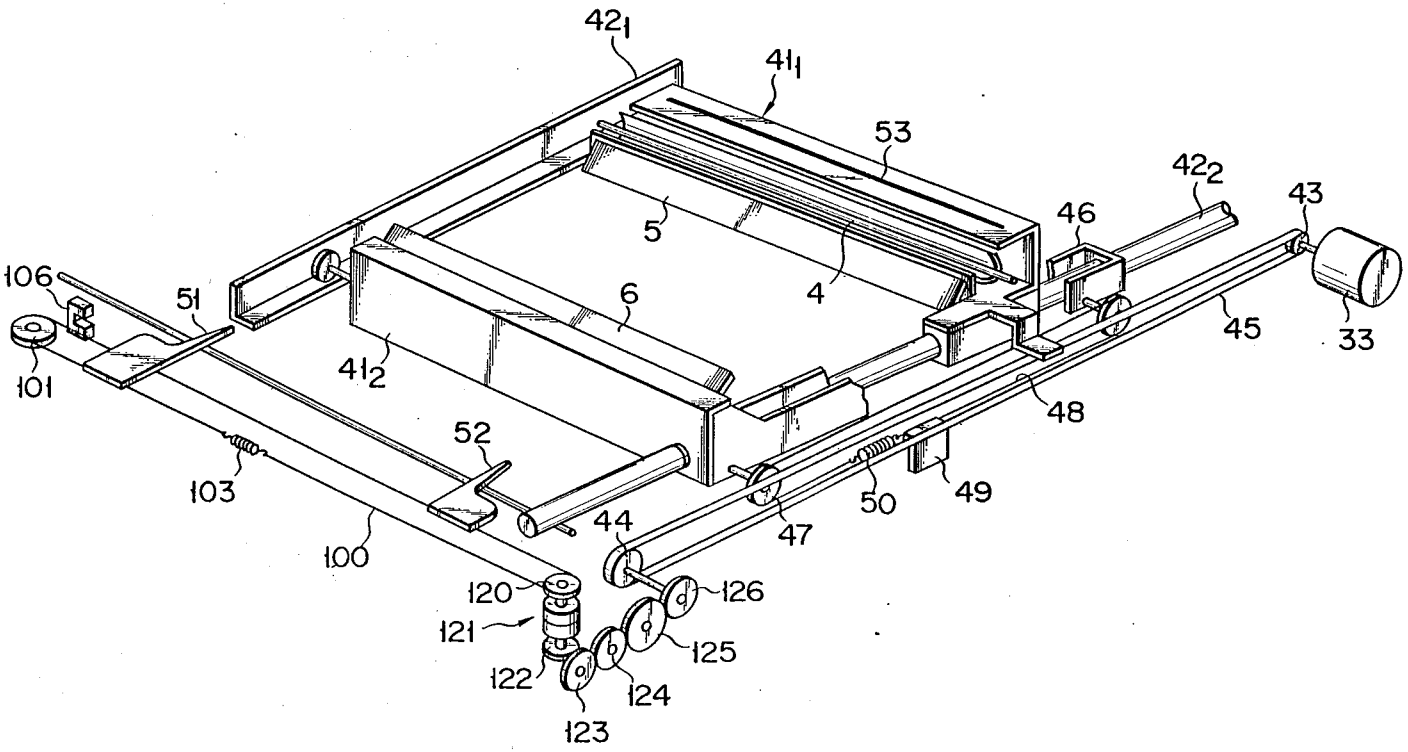
FIG. 11 is a perspective view showing only the major part of another image forming apparatus which permits indicators to be moved relative to each other in interlocking movement with the first carriage to set an image-reproducible range.

The same reference numerals are employed in FIG. 11 to designate parts or elements corresponding to those in FIGS. 1 to 5 and 7, except for different parts or elements as noted.

FIG. 11 is a view showing the use of, for example, an electromagnetic clutch as an interlocking means. In FIG. 11, indicators 51, 52 are each attached to different parallel runs of wire 100 which is stretched between pulleys 101 and 120 through spring 103. Gear 122 is coupled to pulley 120 through electromagnetic clutch 121 and gear 122 is in mesh with gear 126 through gears 123, 124 and 125. Gear 126 is coupled to idle pulley 44.

Figure 9:
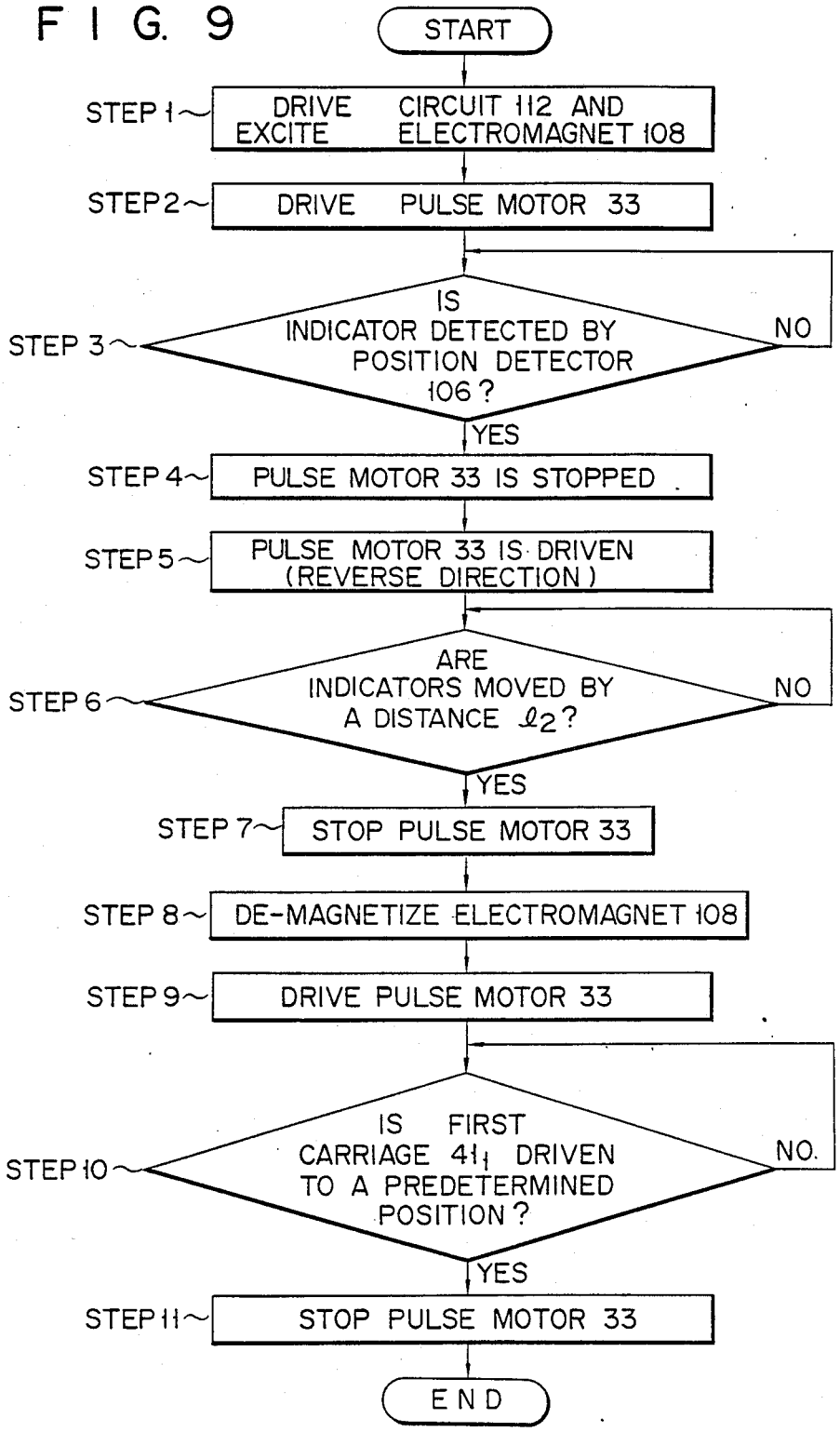
FIG. 9 is a flow chart for explaining the processor functions for displaying an image-reproducible range.
Figure 10:
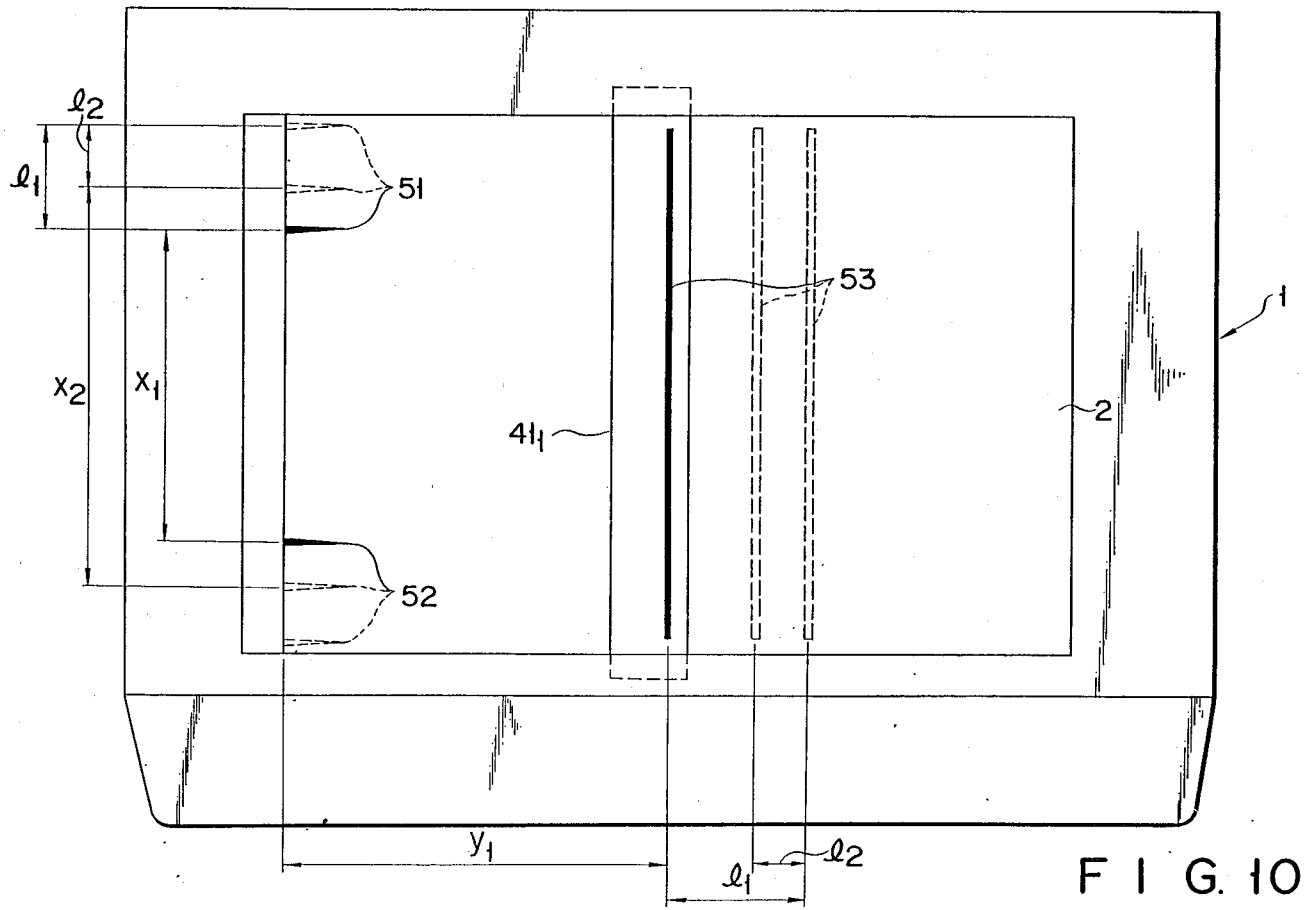
FIG. 10 is a plan view for explaining the operation of FIGS. 7 and 8.

In the arrangement shown in FIG. 11, the same flow chart as shown in FIG. 9 is used except that electromagnetic clutch 121 is excited, in place of driving holding means 107, when an image-reproducible range is to be displayed. The flow chart of FIG. 11 is therefore omitted. That is, in order for the image-reproducible range to be displayed, electromagnetic clutch 121 is excited, coupling pulley 120 to gear 122. When in this state first carriage $41_1$ is moved in a direction away from indicators 51 and 52 as in the embodiment shown in FIGS. 7 and 8, it is operated in cooperation with wire 100. When indicator 51 is detected by position detector 106, first carriage $41_1$ is stopped by the output signal of main processor group 71. Then, first carriage $41_1$is driven toward indicators 51, 52 by the output signal of main processor group 71. When indicators 51 and 52 are moved relative to each other to obtain a distance therebetween corresponding to the set ratio, first carriage $41_1$ is stopped. In this state, electromagnetic clutch 121 is de-magnetized by an output signal of drive circuit 112 through main processor group 71. Then, scale 53 is moved to a position corresponding to the set ratio.

Even in this embodiment it is possible to obtain the same advantages as in the embodiment of FIGS. 7 and 8.

Although in this embodiment the electromagnetic clutch has been used as a coupling means, it is not restricted thereto. It may be possible to use, for example, a spring clutch instead.

It is to be understood that various changes and modifications may be made by those skilled in the art without departing from the scope or spirit of this invention.

According to this invention an image forming apparatus is formed which can provide a low-cost display means without increasing the number of component parts required.

What is claimed is:

1. An image forming apparatus for forming a magnified/reduced image from an original onto a sheet in accordance with a selected magnification/reduction factor, comprising:

photosensitive means for holding an electric charge on a surface thereof;

charging means for uniformly applying said electric charge to said surface of the photosensitive means;

original table means for carrying an original thereon;

image exposure means for exposing said surface of said photosensitive means with a light beam corresponding to an image of said original, thereby forming an electric charge pattern corresponding to the original image on said surface of said photosensitive means;

developing means for developing said electric charge pattern;

magnification/reduction setting means for setting said magnification/reduction factor;

display means and optical scanning means for displaying an inner-reproducible range corresponding to said magnification/reduction factor and the size of the sheet on which said image is formed;

pulse motor means for moving said optical scanning means;

interlocking means for interlockingly moving said display means with a movement of said optical scanning means; and control means for controllably driving said interlocking means in accordance with the image-reproducible range.

2. The image forming apparatus according to claim 1, wherein said optical scanning means indicates a distance along said optical scanning means as measured from one side edge of said original table means, which distance corresponds to the image-reproducible range, and wherein said display means includes two indicators which indicate a distance therebetween measured along said one side edge of the original table means.

3. The image forming apparatus according to claim 2, wherein said interlocking means includes holding means, mounted on said optical scanning means, for selectively arresting movement of a wire to which said two indicators are attached.

4. The image forming apparatus according to claim 3, wherein said wire is turned back upon itself to provide two parallel runs, each of said indicators being attached to a different run of said wire.

5. The image forming apparatus according to claim 4, wherein said holding means includes an electromagnet, an armature attracted by said electromagnet in a given direction, a pressure contact member for arresting movement of said wire in cooperation with the armature which is attracted toward the pressure contact member, and a spring for urging the armature away from the electromagnet.

6. The image forming apparatus according to claim 5, wherein said pressure contact member includes a material having a high coefficient of friction.

7. The image forming apparatus according to claim 4, wherein said control means controls said interlocking means to cause said indicators to be interlockingly moved with movement of said optical scanning means and, when said indicators are moved relative to each other to leave a distance therebetween corresponding to said magnification/reduction factor and said sheet size, only the optical scanning means can be moved with said holding means being released.

8. The image forming apparatus according to claim 7, further comprising a position detector located in a position corresponding to a reference position of one of said indicators, and wherein, after said one indicator has been detected by the position detector, the indicators are moved toward each other to leave a distance therebetween corresponding to said magnification/reduction factor and said sheet size.

9. The image forming apparatus according to claim 2, wherein said optical scanning means includes a belt which transmits movement to said wire, and a pulse motor for driving said belt, and wherein said interlocking means includes an electromagnetic clutch which selectively transmits movement of said belt to said wire.

10. The image forming apparatus according to claim 9, wherein said wire is turned back upon itself through pulley means to provide two parallel runs, and wherein each of said indicators is attached to a different one of said two runs to cause said wire to be moved through said pulley means.

11. The image forming apparatus according to claim 10, wherein said control means excites said electromagnetic clutch to cause said indicators to be interlockingly moved with a movement of said optical scanning means and, when said indicators are moved to leave a distance therebetween corresponding to said magnification/reduction factor and said sheet size, said control means deenergizes said electromagnetic clutch to cause movement of only the optical scanning means.

12. The image forming apparatus according to claim 11, further comprising a position detector located in a position corresponding to a reference position of one of said indicators, and wherein, after said one indicator has been detected by the position detector, said indicators are moved toward each other to leave a distance therebetween corresponding to said magnification/reduction factor and said sheet size.

13. An image forming apparatus for forming an image according to a selected magnification/reduction factor, comprising:

photosensitive means for holding an electrical charge on a surface thereof;

charging means for uniformly applying said electric charge to said surface of said photosensitive means;

original table means for carrying an original thereon;

an optical scanning device movable with respect to said original table and having first optical means adapted for optically scanning said original placed on said original table means, and second optical means for extracting an image reflected by said first optical means from said original with said selected magnification/reduction factor;

image exposure means for exposing said surface of said photosensitive means with a light beam corresponding to the reflected image extracted by said optical scanning means to form an electric charge pattern corresponding to said reflected image;

developing means for developing said electric charge pattern on said surface on said photosensitive means;

means for determining an image-reproducible range corresponding to said selected magnification/reduction ratio and a size of a sheet upon which said image is to be formed;

first and second display means for displaying said image-reproducible range;

pulse motor means for moving said first display means;

interlocking means for interlockingly moving said second display means with the movement of said first display means; and control means for controllably driving said interlocking means in accordance with said image-reproducible range.

14. The image-forming apparatus according to claim 13 wherein said first display means is provided on said optical scanning means and displays a distance measured along said original table means from one side edge thereof, said measured distance corresponding to said image-reproducible range, and wherein said second display means includes first and second indicators which are adapted to show a distance therebetween measured along said one side edge of said original table means, and wherein said pulse motor moves said optical scanning means.

15. An image-forming apparatus for forming a magnified/reduced image from an original onto a sheet in accordance with a selected magnification/reduction factor, comprising:

means adapted for transferring an image from said original onto said sheet in accordance with said selected magnification/reduction factor;

magnification/reduction setting means for setting said magnification/reduction factor;

display means for displaying a first dimension of an image-reproducible range corresponding to said magnification/reduction factor;

optical scanning means for displaying a second dimension of said image-reproducible range corresponding to said magnification/reduction factor;

interlocking means for interlockingly moving said display means with a movement of said optical scanning means; and control means for controllably driving said interlocking means in accordance with the image-reproducible range.

16. A method for displaying an image-reproducible range of an original sheet in accordance with a selected magnification/reduction factor, comprising the steps of:

setting a magnification/reduction factor in accordance with the desired magnified/reduced image;

displaying a first dimension of an image-reproducible range corresponding to said magnification/reduction factor, including the step of driving two display indicators to cause said first dimension to be displayed therebetween;

displaying a second dimension of said image-reproducible range corresponding to said magnification/reduction factor, including the step of driving a carriage to a position where said second dimension exists between said carriage and said two indicators.

17. A method according to claim 16 wherein said step of driving said carriage is performed substantially simultaneously with said step of driving said two indicators.

18. A method according to claim 17 further including the step of arresting movement of said two indicators when said first dimension has been displayed, while continuing to drive said carriage to said position to display said second dimension.

* * * * *